US009534468B2

(12) United States Patent
Emmett

(10) Patent No.: US 9,534,468 B2
(45) Date of Patent: Jan. 3, 2017

(54) TENSION HANGER SYSTEM AND METHOD

(71) Applicant: Cameron International Corporation, Houston, TX (US)

(72) Inventor: Jacob Charles Emmett, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/657,879

(22) Filed: Mar. 13, 2015

(65) Prior Publication Data

US 2016/0265299 A1 Sep. 15, 2016

(51) Int. Cl.
*E21B 34/04* (2006.01)
*E21B 33/04* (2006.01)

(52) U.S. Cl.
CPC ..... *E21B 33/04* (2013.01)

(58) Field of Classification Search
CPC ... E21B 33/04; E21B 33/0415; E21B 33/0422
See application file for complete search history.

(56) References Cited

U.S. PATENT DOCUMENTS 4,278,278 A * 7/1981 Chambless ..... E21B 33/04 166/240
4,501,441 A * 2/1985 Crews ..... E21B 33/04 285/123.9
4,601,343 A 7/1986 Lindsey, Jr. et al.
5,878,816 A 3/1999 Lalor et al.
6,543,533 B2 * 4/2003 Meek ..... E21B 43/127 166/104
2012/0085552 A1 * 4/2012 Travis ..... E21B 33/0415 166/382
2014/0151069 A1 * 6/2014 Kajaria ..... E21B 33/047 166/382
2015/0034338 A1 * 2/2015 Lim ..... E21B 33/035 166/386

FOREIGN PATENT DOCUMENTS

GB 2057032 A 3/1981

OTHER PUBLICATIONS

PCT International Search Report and Written Opinion; Application No. PCT/US2016/019195; Dated Jun. 9, 2016; 13 pages.

* cited by examiner

*Primary Examiner* — James G Sayre
(74) *Attorney, Agent, or Firm* — Fletcher Yoder, P.C.

(57) ABSTRACT

Present embodiments are directed towards a system comprising a tension hanger having a parent bowl configured to mount in a mineral extraction system, wherein the parent bowl comprises a first retaining slot formed in an inner diameter of the parent bowl, wherein the first retaining slot is at least partially defined by an upper surface, a lower surface, a first side surface, and a second side surface, wherein the upper surface, lower surface, first side surface, and second side surface form a J-shaped configuration and a mandrel hanger configured to be disposed within the parent bowl, wherein the mandrel hanger comprises a first load shoulder configured to be positioned within the first retaining slot.

21 Claims, 8 Drawing Sheets

TENSION HANGER SYSTEM AND METHOD

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are employed to access and extract the resource. These systems can be located onshore or offshore depending on the location of a desired resource. Further, such systems generally include a wellhead assembly that is used to extract the resource. These wellhead assemblies include a wide variety of components and/or conduits, such as various control lines, casings, valves, and the like, that are conducive to drilling and/or extraction operations. In drilling and extraction operations, in addition to wellheads, various components and tools are employed to provide for drilling, completion, and the production of mineral resources. For instance, during drilling and extraction operations seals and valves are often employed to regulate pressures and/or fluid flow.

A wellhead system often includes a tubing hanger or casing hanger that is disposed within the wellhead assembly and configured to secure tubing and casing suspended in the well bore. In addition, the hanger generally regulates pressures and provides a path for hydraulic control fluid, chemical injections, or the like to be passed through the wellhead and into the well bore. In certain applications, such as artificial lift applications, the hanger and the tubing string are suspended in tension within the wellhead assembly. Unfortunately, existing hangers may be susceptible to stress concentrations and/or may be otherwise difficult to land and/or retain within a wellhead assembly.

BRIEF DESCRIPTION OF THE DRAWINGS

Various features, aspects, and advantages of the present disclosure will become better understood when the following detailed description is read with reference to the accompanying figure, wherein.

DETAILED DESCRIPTION OF SPECIFIC EMBODIMENTS

Figure 1:
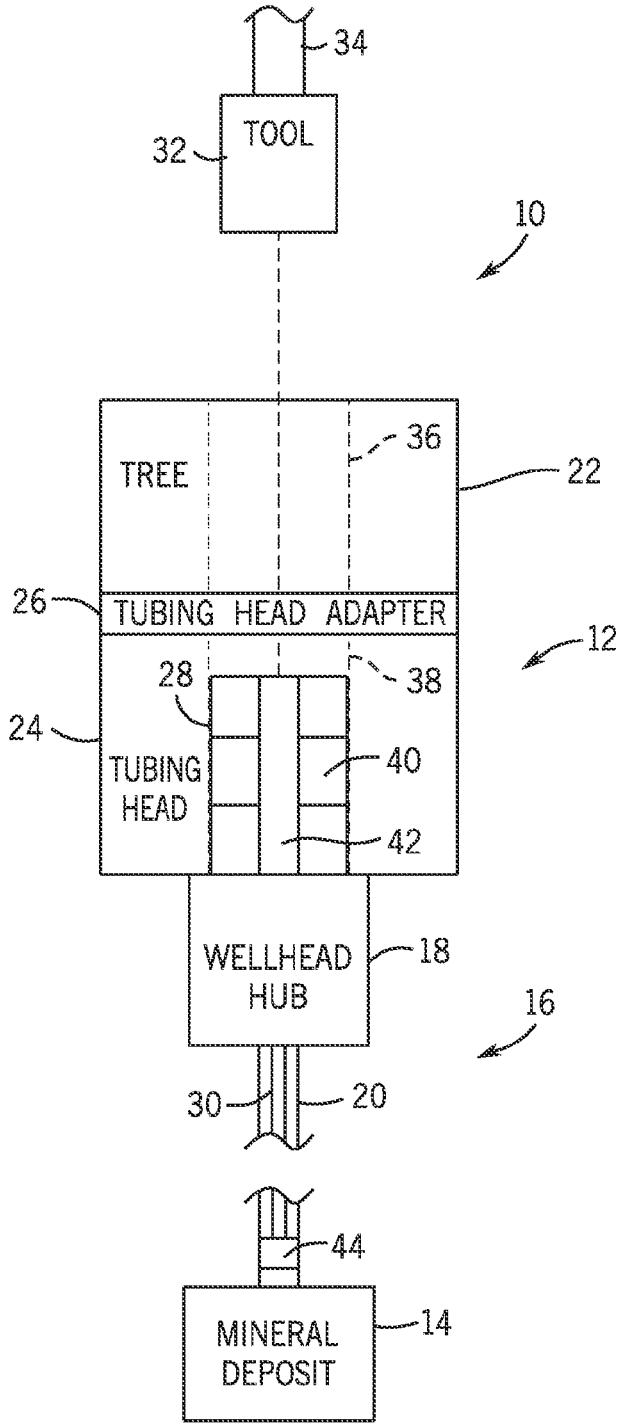
FIG. 1 is a block diagram that illustrates a mineral extraction system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present disclosure include a system and method that addresses one or more of the above-mentioned inadequacies of conventional tension hangers. As explained in greater detail below, the disclosed embodiments include a tension hanger having features to improve retention of the tension hanger within a wellhead assembly and/or to improve loading on the tension hanger. For example, in certain embodiments, the tension hanger may include a mandrel hanger having one or more angled load shoulders. As discussed below, the one or more angled load shoulders may reduce stress concentrations in the mandrel hanger when the tension hanger is loaded (e.g., supporting a suspended tubing string in tension). Additionally, the one or more angled load shoulders (e.g., the reduction of stress concentrations in the mandrel hanger) may enable the manufacture of the mandrel hanger from a material such as stainless steel instead of more expensive alloys. Furthermore, in certain embodiments, the tension hanger may include a parent bowl having one or more slots (e.g., J-slots, internal slots, etc.) configured to securely retain the mandrel hanger of the tension hanger in the parent bowl once tension in the tension hanger is set. For example, the one or more slots may each include a step, stop, or other surface configured to mechanically retain the mandrel hanger within the parent bowl. In certain embodiments, the slots may enable secure retention of the mandrel hanger within the parent bowl after a tubing head adapter is installed. The one or more slots (e.g., the step, stop, or other surface of each slot) may also enable the breaking out of a landing joint (e.g., between the mandrel hanger and a running tool). As discussed below, present embodiments may enable the setting and retaining of a tubing string in tension without detent pins or other components used in conventional tension hangers.

FIG. 1 is a block diagram that illustrates a mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well bore 20.

The wellhead hub 18 generally includes a large diameter hub that is disposed at the termination of the well bore 20. The wellhead hub 18 provides for the connection of the wellhead 12 to the well 16. For example, the wellhead 12 includes a connector that is coupled to a complementary connector of the wellhead hub 18. In one embodiment, the wellhead hub 18 includes a DWHC (Deep Water High Capacity) hub, and the wellhead 12 includes a complementary collet connector (e.g., a DWHC connector).

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well bore 20 (down-hole). In the illustrated embodiment, the wellhead 12 includes what is colloquially referred to as a christmas tree 22 (hereinafter, a tree), a tubing head 24 (e.g., tubing spool), a tubing head adapter 26, and a hanger 28 (e.g., a tension hanger) configured to suspend a tubing string 30 (or casing string) within the well bore 20. The system 10 may include other devices that are coupled to the wellhead 12, and devices that are used to assemble and control various components of the wellhead 12. For example, in the illustrated embodiment, the system 10 includes a tool 32 suspended from a drill string 34. In certain embodiments, the tool 32 includes a retrievable running tool that is lowered (e.g., run) from an offshore vessel to the well 16 and/or the wellhead 12. In other embodiments, such as surface systems, the tool 32 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 36. The tree bore 36 provides for completion and workover procedures, such as the insertion of tools (e.g., the hanger 28) into the well 16, the injection of various chemicals into the well 16 (down-hole), and the like. Further, minerals extracted from the well 16 (e.g., oil and natural gas) may be regulated and routed via the tree 22. For instance, the tree 22 may be coupled to a jumper or a flowline that is tied back to other components, such as a manifold. Accordingly, produced minerals flow from the well 16 to the manifold via the wellhead 12 and/or the tree 22 before being routed to shipping or storage facilities.

The tubing head 24 provides a base for the wellhead 12 and/or an intermediate connection between the wellhead hub 18 and the tree 22. Typically, the tubing head 24 is one of many components in a modular subsea or surface mineral extraction system 10 that is run from an offshore vessel or surface system. The tubing head 24 includes the tubing head bore 38. The tubing head bore 38 connects (e.g., enables fluid communication between) the tree bore 36 and the well 16. Thus, the tubing head bore 38 may provide access to the well bore 20 for various completion and workover procedures. For example, components can be run down to the wellhead 12 and disposed in the tubing head bore 38 to seal-off the well bore 20, to inject chemicals down-hole, to suspend tools down-hole, to retrieve tools down-hole, and the like.

In certain embodiments, such as artificial lift applications, the tubing string 30 may be set in tension within the well bore 20 and wellhead 12. In such applications, the hanger 28 (e.g., tension hanger) is disposed within the wellhead 12 to secure tubing suspended in tension in the well bore 20, and to provide a path for hydraulic control fluid, chemical injections, and the like. The hanger 28 includes a parent bowl 40 secured within the tubing head bore 38 of the tubing head 24 and a mandrel hanger 42 secured within the parent bowl 40. As will be appreciated, the parent bowl 40 and the mandrel hanger 42 may be lowered into the tubing head 24, and a packer assembly 44 (e.g., annular packer) on the tubing string 30 within the well bore 20 may be set. The mandrel hanger 42, which is coupled the tubing string 30, is lifted and securely retained within the parent bowl 40 to set the tubing string 30 in tension within the well bore 20. This process is described in further detail below. As mentioned above, the parent bowl 40 and the mandrel hanger 42 may include features to improve this process and/or to improve the retention of the hanger 28 and its components (e.g., the parent bowl 40 and the mandrel hanger 42) within the tubing head 24. These features are described in further detail below.

Figure 2:
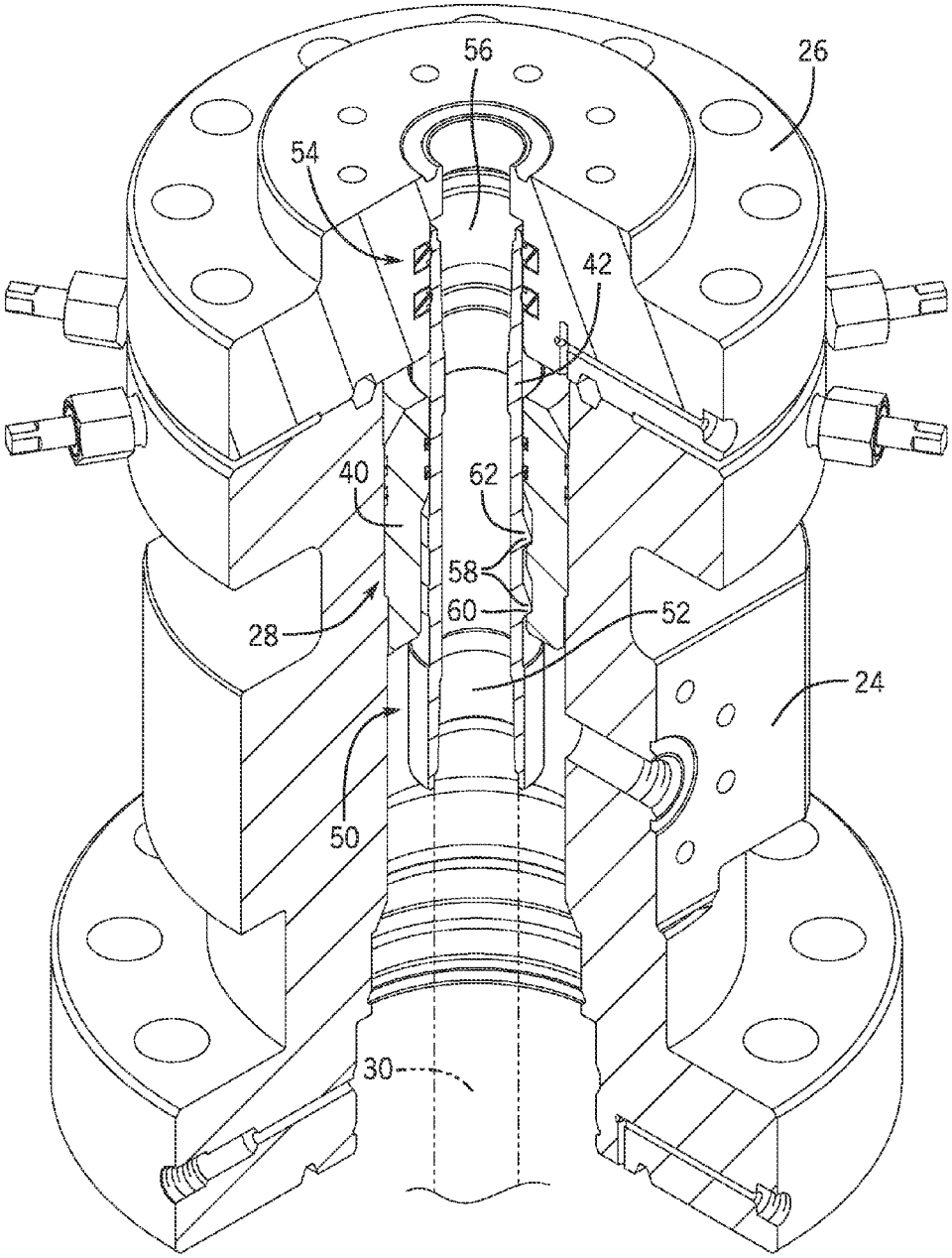
FIG. 2 is a cutaway perspective view of a tubing head having a tension hanger, in accordance with an embodiment of the present disclosure.

FIG. 2 is a cutaway perspective view of an embodiment of the tubing head 24 having the hanger 28 including the parent bowl 40 and the mandrel hanger 42. The parent bowl 40 is secured within the tubing head 24, and the mandrel hanger 42 is secured within the parent bowl 40. Additionally, the tubing head adapter 26 is installed over the tubing head 24, which further retains the mandrel hanger 42 within the tubing head 24 in the manner described below.

As discussed above, the hanger 28 may support the tubing string 30 in tension within the well bore 20. Specifically, the mandrel hanger 42 couples to the tubing string 30 at a first end 50 of the mandrel hanger 42. In the illustrated embodiment, the first end 50 of the mandrel hanger 42 includes threads 52 that engage with threads of the tubing string 30. A second end 54 of the mandrel hanger 42 may also include threads 56 configured to engage with threads of the tool 32 when the tool 32 runs the mandrel hanger 42 into the tubing head 24 and parent bowl 40. In certain embodiments, the mandrel hanger 42 may include a back pressure valve (BPV) to enable containment of pressure within the tubing string 30 (e.g., production tubing string).

The load of the tubing string 30 supported by the hanger 28 is transferred from the mandrel hanger 42 to the parent bowl 40 via load shoulders 58 of the mandrel hanger 42. In the illustrated embodiment, the mandrel hanger 42 includes two sets of load shoulders 58. That is, a first set of load shoulders 60 is located at a first axial position of the mandrel hanger 42, and a second set of load shoulders 62 is located at a second axial position of the mandrel hanger 42. Each set of load shoulders 58 (e.g., first set 60 and second set 62) includes two load shoulders 58 disposed approximately 180 degrees apart about a circumference of the mandrel hanger 42. One or more load shoulder 58 is configured to engage with a respective slot formed in the parent bowl 40. As mentioned above, the load shoulders 58 may be angled to reduce stress concentrations in the mandrel hanger 42. In other words, each load shoulder 58 may have an angled surface that engages with a mating angled surface of the parent bowl 40. For example, the mating angled surfaces of the parent bowl 40 may be formed in the one or more slots (e.g., J-shaped slots) configured to mechanically retain the mandrel hanger 42 within the parent bowl 40 and the tubing head 24. The configurations of the angled load shoulders 58 and the slots of the parent bowl 40 are discussed in further detail with reference to FIGS. 7-9.

Figure 3:
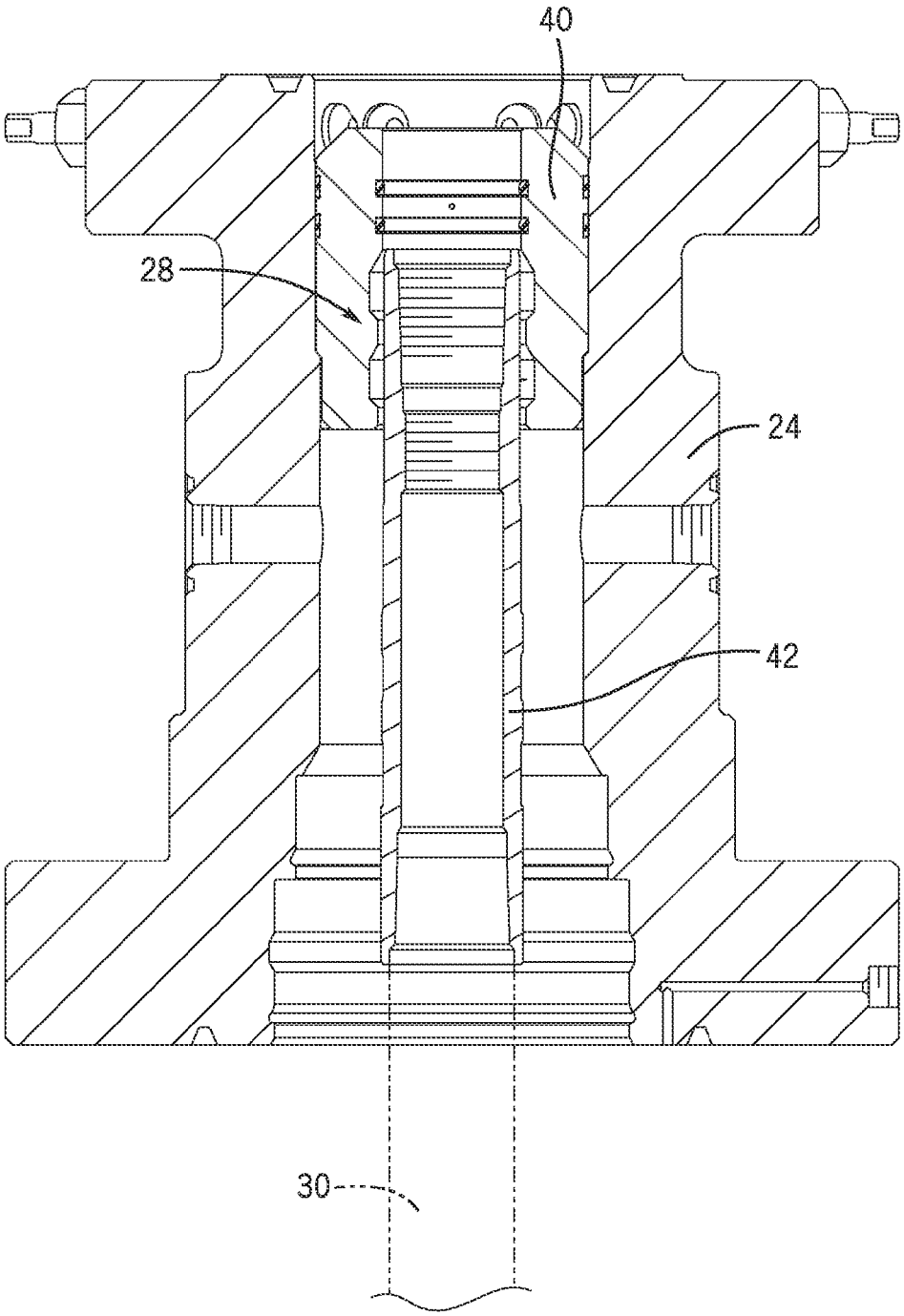
FIG. 3 is a cutaway side view of a tubing head having a tension hanger, illustrating a mandrel hanger of the tension hanger in a packer setting position, in accordance with an embodiment of the present disclosure.

FIGS. 3-6 are cutaway side views of the tubing head 24 and the hanger 28, illustrating landing and retention of the hanger 28 within the tubing head 24 when the hanger 28 is suspending the tubing string 30 in tension within the well-bore 20. First, FIG. 3 illustrates the parent bowl 40 secured within the tubing head 24. As discussed below, the parent bowl 40 may be retained within the tubing head 24 via lock screws or other mechanical retention feature.

The illustrated embodiment also shows the mandrel hanger 42 being run into the tubing head 24. At the surface, the mandrel hanger 42 is disposed within the parent bowl 40 (e.g., the parent bowl 40 is positioned over the mandrel hanger 42), the mandrel hanger 42 is coupled to the tubing string 30 (e.g., via threads 52 at the first end 50 of the mandrel hanger 42), and the parent bowl 40 and the mandrel hanger 42 may then be run into the tubing head 24 together using the tool 32 (e.g., a landing joint). As discussed below, the mandrel hanger 42 may be oriented in a first position (e.g., a first rotational position) to enable the load shoulders 58 of the mandrel hanger 42 to pass or traverse slots or shoulders (e.g., slots 84, shoulders 88 and 90, etc.) in the parent bowl 40 to position the packer assembly 44 within the well bore 20. Once the packer assembly 44 at the bottom end of the tubing string 30 is set within the well bore 20, the mandrel hanger 42 is then lifted (e.g., within the landed parent bowl 40) to create tension within the tubing string 30 (and/or casing string).

Figure 4:
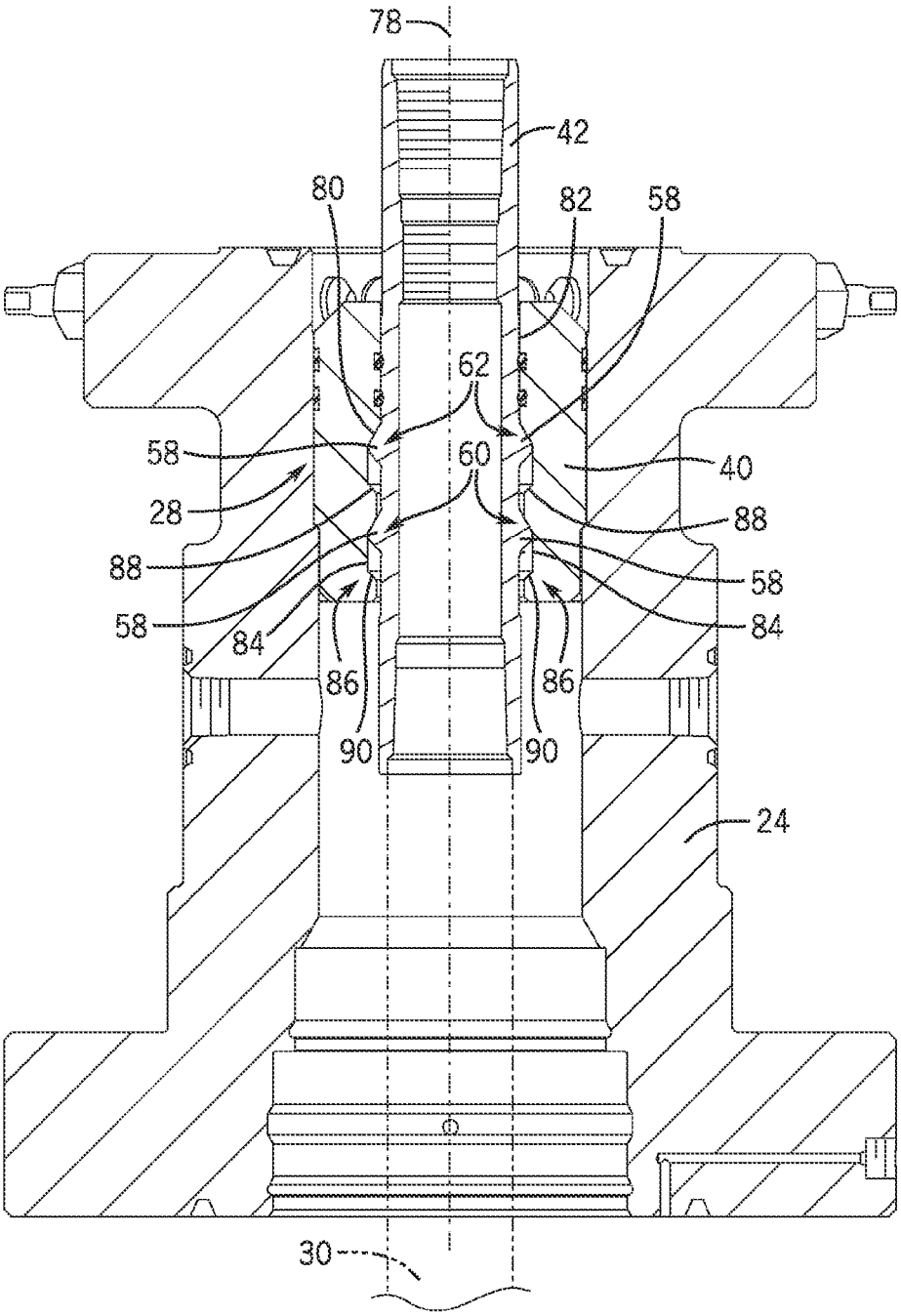
FIG. 4 is a cutaway side view of a tubing head having a tension hanger, illustrating a mandrel hanger of the tension hanger in a topped out or lifted position, in accordance with an embodiment of the present disclosure.

FIG. 4 illustrates the mandrel hanger 42 coupled to the tubing string 30 and in a lifted position. When the mandrel hanger 42 is in the first position, the load shoulders 58 may pass the shoulders 88 and 90 (which may be part of respective slots 84) to enable lowering the mandrel hanger 42 and the tubing string 30 in to the well bore. After the packer assembly 44 is set, the mandrel hanger 42 is lifted. An upper shoulder 80 (e.g., continuous shoulder) of the parent bowl 40 may block the mandrel hanger 42 from being lifted further out of the tubing head 24. That is, the upper shoulder 80 may form an inner diameter of the parent bowl 40 that is smaller than an outer diameter of the mandrel hanger 42 defined by the load shoulders 58, thereby causing the upper shoulder 80 to block upward movement of the mandrel hanger 42.

As mentioned above, the mandrel hanger 42 is rotated to adjust the mandrel hanger 42 from the first position (e.g., first rotational position), when the tubing string 30 is run into the well bore 20, to a second position (e.g., a second rotational position) after the mandrel hanger 42 is lifted. For example, the second position may be approximately 90 degrees from the first position. In other words, the mandrel hanger 42 may be rotated (e.g., about a central axis 78 of the mandrel hanger 42) approximately 90 degrees from the first position to the second position.

Each of the lower shoulders 88 and 90 of the parent bowl 40 extends partially about an inner diameter 82 of the parent bowl 40. As a result, the lower shoulders 88 and 90 may block downward of the mandrel hanger 42 when the mandrel hanger 42 is oriented in the second rotational position, while enabling downward movement of the mandrel hanger 42 when the mandrel hanger 42 is oriented in the first rotational position. For example, each shoulder 88 and 90 may extend approximately 30, 40, 50, 60, 70, 80, or 90 degrees about a circumference of the inner diameter 82 of the parent bowl 40. Thus, in the first rotational position, the load shoulders 58 of the mandrel hanger 42 and the shoulders 88 and 90 of the parent bowl 40 may be offset (e.g., approximately 90 degrees) from one another, thereby enabling unrestricted upward and downward movement (relative to the shoulders 88 and 90) of the mandrel hanger 42 within the parent bowl 40. However, it should be noted that the upper shoulder 80 may still block upward movement of the mandrel hanger 42 when the mandrel hanger 42 is in the first rotational position and the second rotational position. In the second rotational position, the load shoulders 58 and the shoulders 88 and 90 may be aligned with one another, thereby enabling engagement of the load shoulders 58 and the shoulders 88 and 90 as the mandrel hanger 42 is landed within the parent bowl 40.

Figure 5:
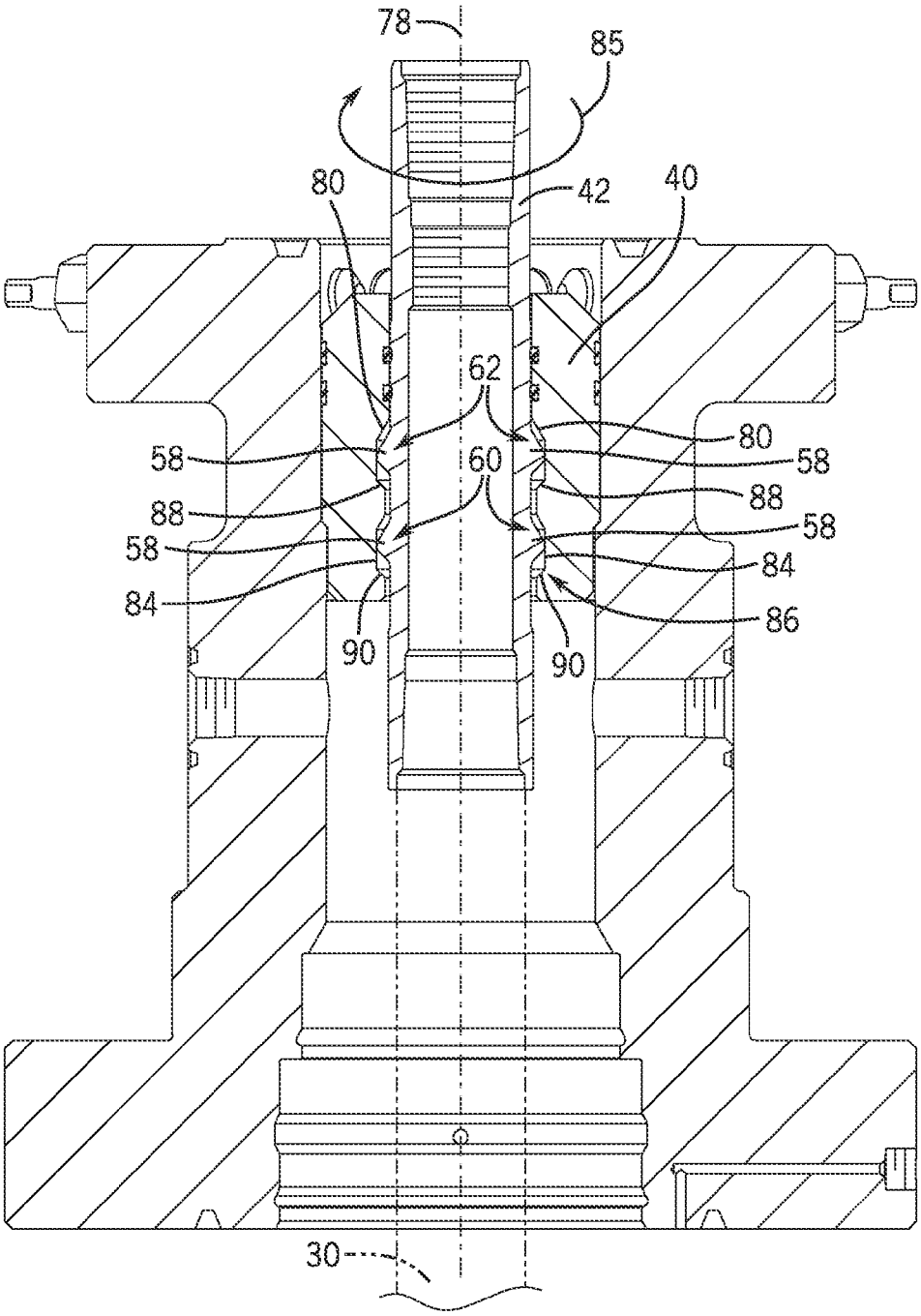
FIG. 5 is a cutaway side view of a tubing head having a tension hanger, illustrating a mandrel hanger of the tension hanger in a rotated position, in accordance with an embodiment of the present disclosure.

Once the mandrel hanger 42 is lifted and the one or more of the load shoulders 58 of the mandrel hanger 42 are blocked by the upper shoulder 80 of the parent bowl 40, the mandrel hanger 42 may be rotated (e.g., via the tool 32) within the parent bowl 40, such that one or more load shoulders 58 engage with one or more retaining slots (e.g., J-shaped slots) 84 formed in the inner diameter 82 of the parent bowl 40. FIG. 5 is a cutaway side view of the tubing head 24 and the hanger 28, illustrating rotation of the mandrel hanger 42 within the parent bowl 40 after upward movement of the mandrel hanger 42 is blocked by the upper shoulder 80 of the parent bowl 40. To land the mandrel hanger 42 within the parent bowl 40, the mandrel hanger 42 may be rotated about the central axis 78 approximately 90 degrees, as indicated by arrow 85. The parent bowl 40 includes at least one retaining slot 84 for at least one load shoulder 58 of the mandrel hanger 42. For example, in the illustrated embodiment of the mandrel hanger 42 having the first set 60 of two load shoulders 58 and the second set 62 of load shoulders 58, the parent bowl 40 has a set 86 of two retaining slots 84 to engage with each of the first set 60 of load shoulders 58. The second set 62 of load shoulders 58 may engage with load shoulders 88 instead of respective slots 84.

As described in detail below, the retaining slots 84 of the parent bowl 40 have a configuration to enable mechanical retention of the mandrel hanger 42 within the parent bowl 40. Specifically, each retaining slot 84 may have a J-shaped configuration that restricts rotation of the mandrel hanger 42 after the mandrel hanger 42 is landed within the parent bowl 40. Each J-shaped retaining slot 84 includes one or more side steps or stops that may abut one or more of the load shoulders 58 of the mandrel hanger 42 to block rotation of the mandrel hanger 42 after the mandrel hanger 42 is rotated into the landed position. The configuration of the retaining slots 84 is described in further detail below with reference to FIGS. 8 and 9.

Figure 6:
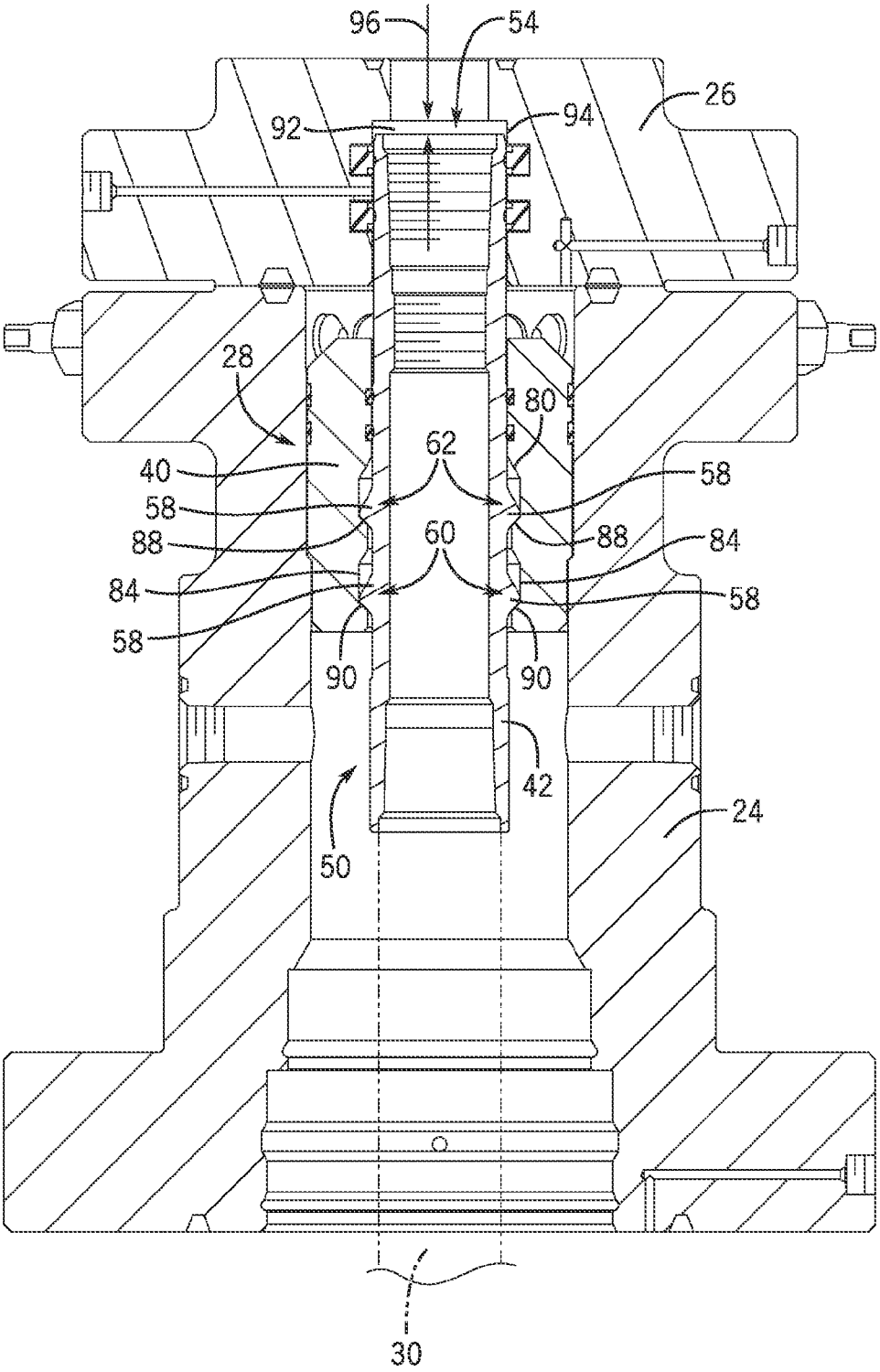
FIG. 6 is a cutaway side view of a tubing head having a tension hanger, illustrating a mandrel hanger of the tension hanger in a landed position, in accordance with an embodiment of the present disclosure.

FIG. 6 illustrates the tubing head 24 with the mandrel hanger 42 landed in the parent bowl 40 and the tubing head adapter 26 secured over the tubing head 24. When the mandrel hanger 42 is landed the parent bowl 40, one or more of the load shoulders 58 of the mandrel hanger 42 is retained within at least one retaining slot 84 of the parent bowl 40. As mentioned above, the one or more retaining slots 84 mechanically retain the load shoulders 58 of the mandrel hanger 42. That is, the one or more retaining slots 84 of the parent bowl 40 limit rotational and axial movement of the mandrel hanger 42. Additionally, the first set 60 of load shoulders 58 of the mandrel hanger 42 are supported by load shoulders 90 of the retaining slots 84. The second set 62 of the load shoulders 58 are supported by the upper load shoulders 88 of the parent bowl 40. The weight of the tubing string 30 (and/or casing string) and the tension in the tubing string 30 that are supported by the mandrel hanger 42 are transferred to the parent bowl 40 (and the tubing head 24) through the load shoulders 58 of the mandrel hanger 42 to the load shoulders 90 of the retaining slots 84 and the upper load shoulders 88 of the parent bowl 40.

The tubing head adapter 26 also mechanically retains the mandrel hanger 42 within the parent bowl 40 and the tubing head 24. When the tubing head adapter 26 is secured over the mandrel hanger 42 and the tubing head 24, there is a gap or clearance 92 between a mandrel hanger recess 94 of the tubing head adapter 26 and the second end 54 of the mandrel hanger 42. A height 96 of the gap 92 may be less than a height (e.g., element 144 in FIG. 8) of a step or side of each retaining slot 84. As will be appreciated, this limits axial movement of the mandrel hanger 42 and blocks inadvertent rotation of the mandrel hanger 42 out of the retaining slots 84 after the mandrel hanger 42 is landed within the parent bowl 40. Additionally, in certain embodiments, the tubing head adapter 26 may be properly installed only if one or more of the load shoulders 58 of the mandrel hanger 42 are properly landed and retained within the one or more respective retaining slots 84 of the parent bowl 40. Thus, when the tubing head adapter 26 is installed, proper landing and retention of the mandrel hanger 42 within the parent bowl 40 may be verified by an operator or user.

Figure 7:
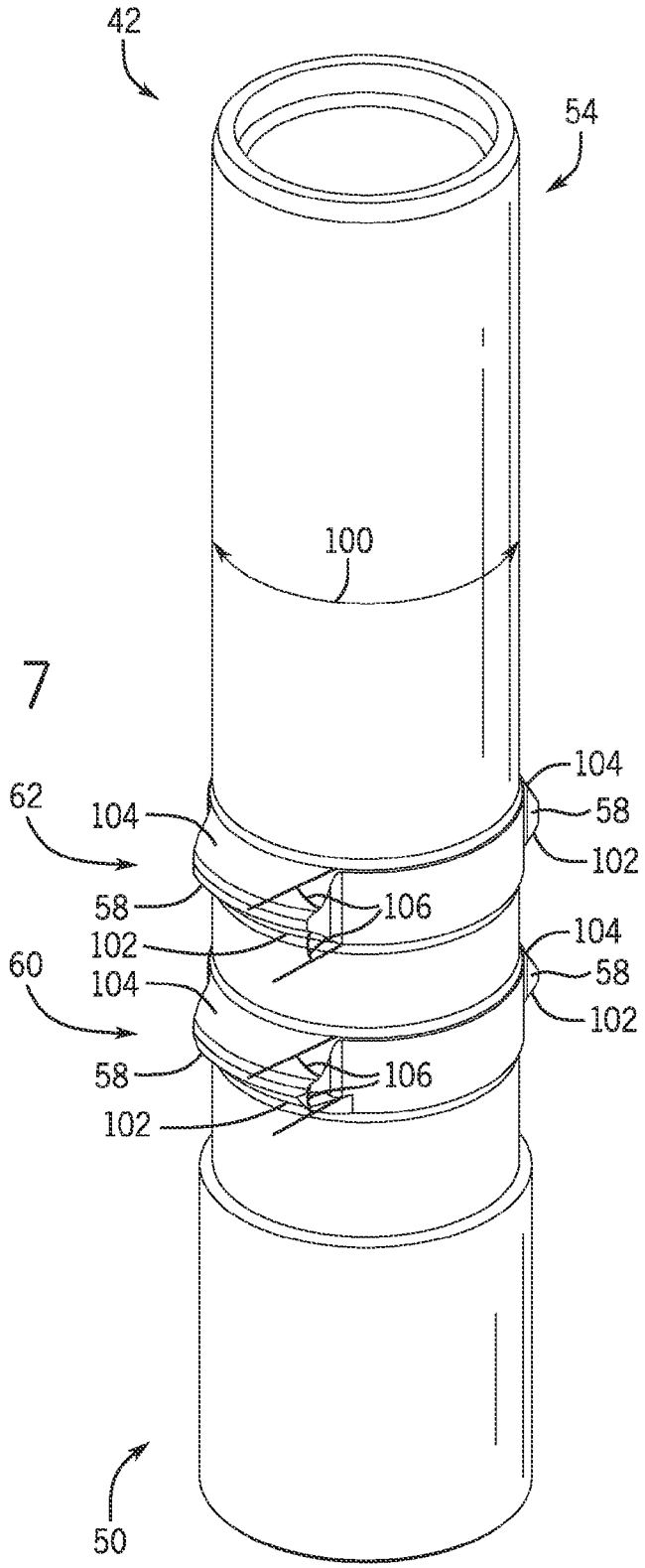
FIG. 7 is a perspective view of a mandrel hanger of the tension hanger, illustrating load shoulders of the mandrel hanger, in accordance with an embodiment of the present disclosure.

FIG. 7 is a perspective view of the mandrel hanger 42 of the tension hanger 28, illustrating the load shoulders 58 of the mandrel hanger 42. As discussed above, one or more load shoulders 58 engage with one or more respective retaining slots 84 of the parent bowl 40 to transfer the load of the tubing string 30 from the mandrel hanger 42 to the parent bowl 40.

The illustrated mandrel hanger 42 includes the first set 60 of two load shoulders 58 at a first axial position of the mandrel hanger 42 and the second set 62 of two load shoulders 58 at a second axial position of the mandrel hanger 42. Each load shoulder 58 may extend around a circumference 100 of the mandrel hanger 42 approximately 20, 25, 30, 35, 40, 45, 50, 55, or any other suitable number of degrees. Additionally, the respective load shoulders 58 of the first and second sets 60 and 62 are offset from one another by approximately 180 degrees about the circumference 100 of the mandrel hanger 42. As discussed in detail above, the load shoulders 58 are configured to traverse the shoulders 88 and 90 of the parent bowl 40 when the mandrel hanger 42 is in a first rotational position, and the load shoulders 58 are configured to engage with the shoulders 88 and 90 of the parent bowl 40 when the mandrel hanger 42 is in a second rotational position (e.g., approximately 90 degrees from the first rotational position).

Moreover, each of the load shoulders 58 of the mandrel hanger 42 are angled load shoulders 58. In other words, each load shoulder 58 has one or more angled surfaces that engage with angled surfaces (e.g., shoulders) of the parent bowl 40 to transfer a load from the mandrel hanger 42 to the parent bowl 40. For example, each load shoulder 58 has a lower angled surface 102 and an upper angled surface 104. As will be appreciated, the lower angled surface 102 of each load shoulder 58 may engage with a respective angled surface (e.g., shoulder of a respective retaining slot 84) of the parent bowl 40 when the mandrel hanger 42 is landed within the parent bowl 40. Similarly, the upper angled surface 104 of each load shoulder 58 in the second set 62 of load shoulders 58 may abut the upper shoulder 80 of the parent bowl 40 when the mandrel hanger 42 is lifted, thereby blocking further lifting of the mandrel hanger 42 and tubing string 30.

The lower and upper angled surfaces 102 and 104 of each load shoulder 58 may be disposed at angles 106 relative to a horizontal axis 108 of the mandrel hanger 42. The angle 106 of each surface 102 and 104 may vary based on design or other considerations. For example, the angle 106 may be approximately 10, 20, 30, 40, 50, or any other suitable number of degrees. The angles 106 of all the lower and upper angled surfaces 102 and 104 may be the same, or the angles 106 of the different surfaces 102 and 104 may vary. As will be appreciated, the lower angled surfaces 102 of the mandrel hanger 42 may reduce stress concentrations in the mandrel hanger 42 when the mandrel hanger 42 is landed in the parent bowl 40 and supporting the weight and tension of the tubing string 30. Moreover, the reduction in stress concentrations may enable manufacture of the mandrel hanger 42 from stainless steel or other metal cheaper than exotic alloys, while still meeting a desired loading requirement (e.g., tension loading, full blind pressure testing, etc.) and/or chemical (e.g., H2S) resistance requirement.

Figure 9:
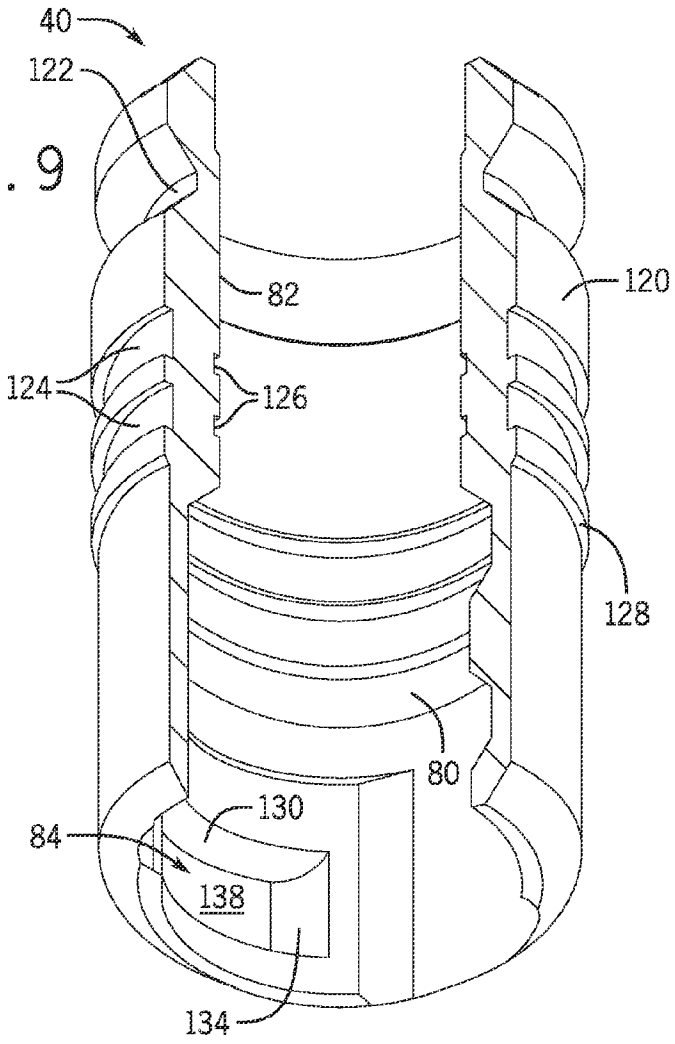
FIG. 9 is a partial cross-sectional perspective view of a parent bowl of the tension hanger, illustrating a retaining slot of the parent bowl, in accordance with an embodiment of the present disclosure.
Figure 8:
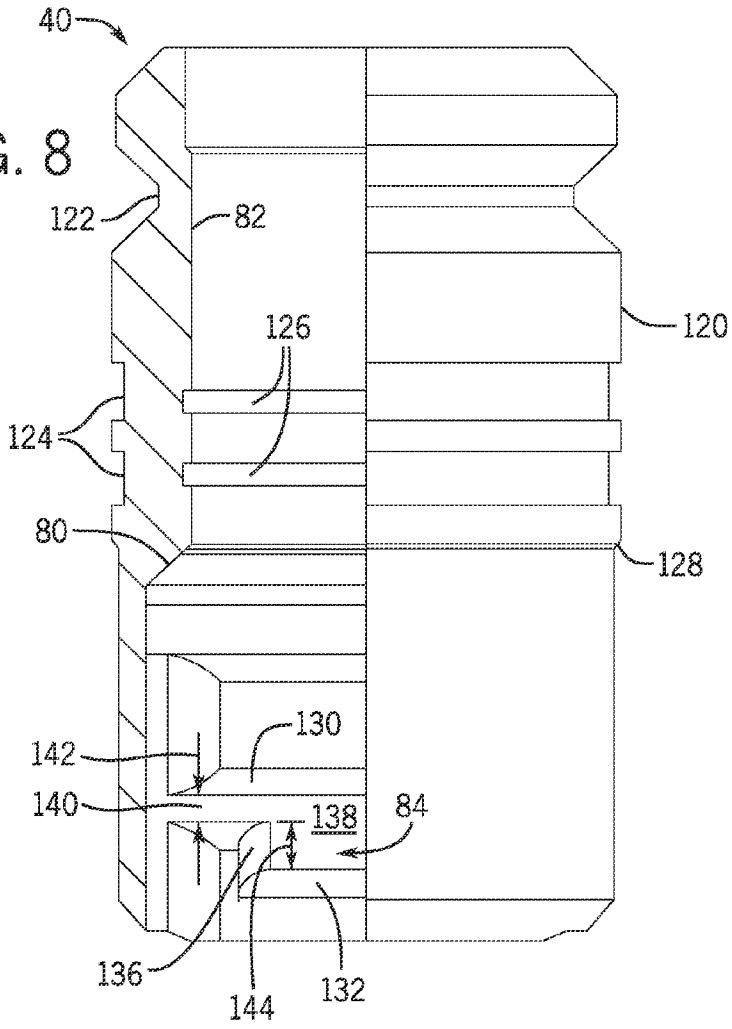
FIG. 8 is a partial cross-sectional side view of a parent bowl of the tension hanger, illustrating a retaining slot of the parent bowl, in accordance with an embodiment of the present disclosure.

FIG. 8 is a partial cross-sectional side view of an embodiment of the parent bowl 40, illustrating one of the retaining slots 84 of the parent bowl 40, and FIG. 9 is a partial cutaway perspective view of the parent bowl 40, illustrating one of the retaining slots 84. As discussed above, the parent bowl 40 is retained within the tubing head 24. To this end, an outer diameter 120 of the parent bowl 40 includes an annular recess 122 in which lock screws may be disposed to secure the parent bowl 40 within the tubing head 24. The outer diameter 120 may also have other recesses 124 (e.g., annular recesses) to support seals (e.g., annular seals) disposed between the parent bowl 40 and the tubing head 24. Similarly, the inner diameter 82 of the parent bowl 40 includes recesses 126 (e.g., annular recesses) to support seals (e.g., annular seals) disposed between the parent bowl 40 and the mandrel hanger 42. The outer diameter 120 of the parent bowl 40 may also include a landing shoulder 128 that engages with a mating shoulder of the tubing head 24 when the parent bowl 40 is disposed within the tubing head 24.

As mentioned above, the parent bowl 40 includes at least one retaining slot 84. The retaining slot 84 is configured to mechanically retain (e.g., axially and/or rotationally) the mandrel hanger 42 when the mandrel hanger 42 is landed within the parent bowl 40. To this end, the retaining slot 84 has a J-shaped configuration. More specifically, the retaining slot 84 is defined by an upper surface 130, a lower surface 132 (e.g., load shoulder or surface), a first side surface 134

(shown in FIG. 9) and a second side surface 136 (e.g., side step). The upper surface 130, lower surface 132, first side surface 134, and second side surface 136 are continuous with one another, form a J-shaped configuration, and generally define a space or pocket 138 in which one of the load shoulders 58 of the mandrel hanger 42 may be positioned when the mandrel hanger 42 is in the landed position. Specifically, the load shoulder 58 (e.g., the lower angled surface 102 of the load shoulder 58) may abut and engage with the lower surface 132 of the retaining slot 84. As will be appreciated, the lower surface 132 of the retaining slot 84 may also be angled similar to the lower angled surface 102 of the load shoulder 58.

As discussed above, to land the mandrel hanger 42 within the parent bowl 40 and engage one of the load shoulders 58 with one of the retaining slots 84, the mandrel hanger 42 is rotated (e.g., approximately 90 degrees). Specifically, the mandrel hanger 42 may be rotated after one or more of the load shoulders 58 (e.g., second set 62 of load shoulders 58) abuts the upper shoulder 80 of the parent bowl 40 to block further upward movement of the mandrel hanger 42. When the mandrel hanger 42 is rotated (e.g., clockwise), one of the load shoulders 58 (e.g., one of the load shoulders 58 in the first set 60) rotates into the retaining slot 84. More specifically, the load shoulder 58 will slide or pass through a gap 140 between the second side surface 136 and the upper surface 130. To this end, the load shoulder 58 may have a height or thickness that is less than a height 142 of the gap 140. Once the mandrel hanger 42 is rotated such that the load shoulder 58 has fully passed through the gap 140, load shoulder 58 is positioned within the pocket 138 of the retaining slot 84, and the load shoulder 58 may rest against the lower surface 132 of the retaining slot 84.

The second side surface 136 (e.g., side step) has a height 144. After the load shoulder 58 passes completely through the gap 140 of the retaining slot 84, the load shoulder 58 and the mandrel hanger 42 will be lowered the distance of height 144, such that the load shoulder 58 abuts the lower surface 132 of the retaining slot 84. In certain embodiments, the height 144 may be approximately 0.3, 0.4, 0.5, 0.6, 0.7, 0.8, 0.9, 1.0, or any other suitable number of inches. Additionally, as discussed above, the height 144 may be greater than the height 96 of the gap 92 between mandrel hanger recess 94 of the tubing head adapter 26 and the second end 54 of the mandrel hanger 42. As will be appreciated, the downward movement of the load shoulder 58 and the mandrel hanger 42 by the distance of height 144 may be observable at a surface of the mineral extraction system to verify the proper landing of the mandrel hanger 42 within the parent bowl 40. Additionally, as the height 144 is greater than the height 96 of gap 92, the tubing head adapter 26 may not be secured to the tubing head 24 without the mandrel hanger 42 properly landing and mechanically retained in the parent bowl 40. Thus, present embodiments enable an operator or user at the surface to verify proper landing and mechanical retention of the mandrel hanger 42 within the parent bowl 40.

The J-shaped configuration of the one or more retaining slots 84 (e.g., integrated retaining slots) also has additional functionality. For example, after the mandrel hanger 42 is landed within the parent bowl 40 and the retaining slots 84 restrict movement respective load shoulders 58 disposed within the retaining slots 84, the first and second side surfaces 134 and 136 provide solid stops to enable breaking out of a landing joint (e.g., tool 32) from the mandrel hanger 42 without any pins to fall out or shear.

As discussed above, embodiments of the present disclosure include the tension hanger 28 having features to improve retention of the tension hanger 28 within the wellhead assembly (e.g., tubing head 24) and/or to improve loading on the tension hanger 28. The tension hanger 28 may include the mandrel hanger 42 having one or more angled load shoulders 58. As discussed above, the one or more angled load shoulders 58 may reduce stress concentrations in the mandrel hanger 42 when the tension hanger 28 is loaded (e.g., supporting the tubing string 30 in tension). Additionally, the one or more angled load shoulders 58 (e.g., the reduction of stress concentrations in the mandrel hanger 42) enable the manufacture of the mandrel hanger 42 from a material such as stainless steel instead of more expensive alloys while still meeting loading or other design constraints. Furthermore, in certain embodiments, the tension hanger 28 includes the parent bowl 40 having one or more retaining slots 84 (e.g., J-shaped slots, internal slots, etc.) configured to securely retain the mandrel hanger 42 of the tension hanger 28 in the parent bowl 40 once the mandrel hanger 42 is landed. For example, the slots 84 may each include a step, stop, or other surface (e.g., first and second side surfaces 134 and 136) configured to mechanically retain the mandrel hanger 42 within the parent bowl 40. In certain embodiments, the slots 84 may enable secure retention of the mandrel hanger 42 within the parent bowl 40 after the tubing head adapter 26 is installed. The retaining slots 84 (e.g., a step, stop, or other surface of each retaining slot 84) may also enable the breaking out of a landing joint (e.g., between the mandrel hanger 42 and running tool 32).

While the present disclosure may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a tension hanger, comprising:

a parent bowl configured to mount in a mineral extraction system, wherein the parent bowl comprises a first retaining slot formed in an inner diameter of the parent bowl, wherein the first retaining slot is at least partially defined by an upper surface, a lower surface, a first side surface, and a second side surface, wherein the first retaining slot comprises a gap extending circumferentially between the upper surface and the second side surface, and the first side surface extends axially from the upper surface to the lower surface; and a mandrel hanger configured to be disposed within the parent bowl, wherein the mandrel hanger comprises a first load shoulder configured to be positioned within the first retaining slot.

2. The system of claim 1, wherein the first load shoulder is configured to be positioned within the first retaining slot via rotation of the mandrel hanger.

3. The system of claim 1, wherein the first load shoulder comprises an angled load shoulder comprising an angled load surface disposed at an angle relative to a horizontal axis of the mandrel hanger.

4. The system of claim 3, wherein the angled load surface is a lower angled load surface configured to abut the lower surface of the first retaining slot when the first load shoulder is disposed within the first retaining slot, and the lower surface of the first retaining slot comprises an angled surface configured to mate with the angled load surface.

5. The system of claim 1, wherein the parent bowl comprises a second retaining slot, and the mandrel hanger comprises a second load shoulder configured to be positioned within the second retaining slot.

6. The system of claim 5, wherein the first and second retaining slots are disposed approximately 180 degrees from one another about an inner diameter of the parent bowl, and the first and second load shoulders are disposed approximately 180 degrees from one another about a circumference of the mandrel hanger.

7. The system of claim 5, wherein the mandrel hanger comprises a first set of load shoulders, the first set of load shoulders comprises the first load shoulder and the second load shoulder, and the mandrel hanger comprises a second set of load shoulders, wherein the second set of load shoulders comprises a third load shoulder and a fourth load shoulder, wherein the first set of load shoulders is disposed at a first axial position along the mandrel hanger, and the second set of load shoulders is disposed at a second axial position of the mandrel hanger.

8. The system of claim 1, wherein the upper surface, the lower surface, the first side surface, and the second side surface form a J-shaped configuration.

9. The system of claim 1, wherein the parent bowl comprises a continuous upper shoulder disposed axially above the first retaining slot.

10. The system of claim 1, comprising a tubing head and a tubing head adapter, wherein the parent bowl is configured to be retained within the tubing head, the tubing head adapter is configured to be secured to the tubing head when the parent bowl is retained within the tubing head and when the mandrel hanger is disposed within the parent bowl, and wherein a clearance between an axial end of the mandrel hanger and a mandrel hanger recess of the tubing head adapter is less than a height of the second side surface when the tubing head adapter is secured to the tubing head.

11. The system of claim 1, wherein the gap comprises a substantially constant height from the second side surface to the upper surface.

12. A method, comprising:

securing a parent bowl within a tubing head;

lowering a mandrel hanger coupled to a tubing string into the parent bowl;

rotating the mandrel hanger to set an annular packer disposed within a well bore;

lifting the mandrel hanger within the parent bowl;

rotating the mandrel hanger within the parent bowl to engage a load shoulder of the mandrel hanger with a J-shaped retaining slot of the parent bowl, wherein rotating the mandrel hanger within the parent bowl to engage the load shoulder of the mandrel hanger with the J-shaped retaining slot of the parent bowl comprises rotating the load shoulder through a circumferential gap extending between a first side surface and an upper surface of the J-shaped retaining slot.

13. The method of claim 12, wherein rotating the mandrel hanger within the parent bowl to engage the load shoulder of the mandrel hanger with the J-shaped retaining slot of the parent bowl comprises rotating the mandrel hanger approximately 90 degrees.

14. The method of claim 12, comprising lowering the mandrel hanger between the first side surface and a second side surface of the J-shaped retaining slot.

15. The method of claim 12, comprising abutting the load shoulder of the mandrel hanger with a first side surface of the J-shaped retaining slot to break out a landing tool from the mandrel hanger after the mandrel hanger is engaged with the J-shaped retaining slot.

16. The method of claim 12, comprising abutting the load shoulder against an upper shoulder of the parent bowl after lifting the mandrel hanger within the parent bowl and before rotating the mandrel hanger within the parent bowl to engage the load shoulder with the J-shaped retaining slot.

17. A system, comprising:

a tubing head;

a parent bowl secured within the tubing head, wherein the parent bowl comprises:

a first retaining slot formed in an inner diameter of the parent bowl, wherein the first retaining slot is at least partially defined by an upper surface, a lower surface, a first side surface, and a second side surface, wherein the upper surface, the lower surface, the first side surface, and the second side surface form a J-shaped configuration with a gap extending circumferentially from an exterior of the first retaining slot to a pocket of the first retaining slot; and a mandrel hanger disposed within the parent bowl, wherein the mandrel hanger comprises a first load shoulder and a second load shoulder, wherein the first and second load shoulders are disposed at a first axial position of the mandrel hanger, the first and second load shoulders are disposed approximately 180 degrees apart about a circumference of the mandrel hanger, and the first load shoulder or the second load shoulder is configured to be retained within the first retaining slot.

18. The system of claim 17, wherein the mandrel hanger comprises a third load shoulder and a fourth load shoulder, wherein the third and fourth load shoulders are disposed at a second axial position of the mandrel hanger offset from the first axial position, and the parent bowl comprises an upper load shoulder configured to support the third and fourth load shoulders when the first load shoulder or the second load shoulder is retained within the first retaining slot.

19. The system of claim 18, wherein each of the first, second, third, and fourth load shoulders comprises an angled lower load shoulder surface configured to abut the parent bowl when the mandrel hanger is landed within the parent bowl.

20. The system of claim 17, wherein the gap is disposed axially between the upper surface and the second side surface.

21. The system of claim 17, comprising a tubing head adapter configured to be secured to the tubing head when the parent bowl is secured within the tubing head and when the mandrel hanger is secured within the parent bowl, wherein a clearance between an axial end of the mandrel hanger and the tubing head adapter is less than a height of the second side surface when the tubing head adapter is secured to the tubing head.

* * * * *